US008353070B1

(12) United States Patent
Johnsen

(10) Patent No.: US 8,353,070 B1
(45) Date of Patent: Jan. 15, 2013

(54) COLLAPSIBLE RAIL SYSTEM

(76) Inventor: Cameron S. Johnsen, Jefferson, SD (US)

( * ) Notice: Subject to any disclaimer, the term of this patent is extended or adjusted under 35 U.S.C. 154(b) by 0 days.

(21) Appl. No.: 13/268,092

(22) Filed: Oct. 7, 2011

Related U.S. Application Data

(60) Provisional application No. 61/392,537, filed on Oct. 13, 2010.

(51) Int. Cl.
*A47C 21/08* (2006.01)

(52) U.S. Cl. ..... 5/430; 5/428; 5/425

(58) Field of Classification Search ..... 5/425–430, 5/512, 663, 193; 256/65.06, 65.12, 65.13, 256/65.14, 67; 108/27; 182/106
See application file for complete search history.

(56) References Cited

U.S. PATENT DOCUMENTS

| | | | | | |
|---|---|---|---|---|---|
| 2,972,153 | A | * | 2/1961 | Turk | 5/429 |
| 3,195,153 | A | * | 7/1965 | Armstrong et al. | 5/430 |
| 3,476,346 | A | * | 11/1969 | Oakes | 5/430 |
| D230,453 | S | | 2/1974 | Harris | |
| 3,851,345 | A | | 12/1974 | Benoit | |
| 3,997,792 | A | | 12/1976 | Conrad | |
| 4,064,575 | A | | 12/1977 | Sanders | |
| 4,103,376 | A | | 8/1978 | Benoit | |
| 4,217,670 | A | * | 8/1980 | Sciongay et al. | 5/425 |
| 4,509,217 | A | | 4/1985 | Therrien | |
| 4,676,687 | A | * | 6/1987 | Koffler | 403/386 |
| 5,187,824 | A | * | 2/1993 | Stryker | 5/430 |
| 5,197,156 | A | * | 3/1993 | Stryker et al. | 5/428 |
| 5,481,772 | A | | 1/1996 | Glynn | |
| 5,802,636 | A | * | 9/1998 | Corbin et al. | 5/425 |
| 6,360,385 | B1 | * | 3/2002 | Lewandowski | 5/430 |
| 6,363,552 | B1 | | 4/2002 | Hornbach | |
| 6,622,323 | B2 | | 9/2003 | Zerhusen | |
| 6,938,289 | B2 | | 9/2005 | Morin | |
| 7,926,130 | B2 | * | 4/2011 | Nagano et al. | 5/430 |
| 2011/0010857 | A1 | * | 1/2011 | Falbo et al. | 5/601 |

* cited by examiner

*Primary Examiner* — Michael Trettel
(74) *Attorney, Agent, or Firm* — Jason L. Gilbert

(57) ABSTRACT

A collapsible rail system for attachment to a variety of surfaces such as a fluoroscopy or radiographic table and easily extended into a raised position or retracted into a lowered position which is flush with the surface. The collapsible rail system generally includes an upper rail, a lower rail and a plurality of post members, wherein each of the post members is pivotally connected to both the upper rail and the lower rail so as to allow the upper rail to collapse onto the lower rail. The lock plate is positioned within a lower channel of the lower rail for locking the rail assembly in an upright position. One or more brackets are provided for removably attaching the rail assembly to a table such as a fluoroscopy or radiographic table.

20 Claims, 8 Drawing Sheets

COLLAPSIBLE RAIL SYSTEM

CROSS REFERENCE TO RELATED APPLICATIONS

I hereby claim benefit under Title 35, United States Code, Section 119(e) of U.S. provisional patent application Ser. No. 61/392,537 filed Oct. 13, 2010. The 61/392,537 application is. The 61/392,537 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a collapsible rail and more specifically it relates to a collapsible rail system for attachment to a variety of surfaces such as a fluoroscopy or radiographic table and easily extended into a raised position or retracted into a lowered position which is flush with the surface.

2. Description of the Related Art

Any discussion of the related art throughout the specification should in no way be considered as an admission that such related art is widely known or forms part of common general knowledge in the field.

Collapsible rails have been in use for years on various surfaces such as tables. However, previously existing collapsible rails have suffered from various shortcomings which negatively impact their efficiency and safety in use. Existing systems often do not collapse their rails to be completely flush with the surface on which they are installed. Thus, they are not as easily to utilize for certain applications such as with fluoroscopy or radiographic tables, where having the rails flush with the table is important for ease in transferring a patient onto and off of the table.

Further, existing collapsible rail systems often fail to fully lock the rails in place when the systems are in a raised position. By only locking some of the rails in an upright position, existing systems are far less reliable and safe to use than a system which locks all rails in an upright position such as the present invention. Finally, many existing rail systems are designed for use with specific tables (i.e. fixedly attached or designed with a specific type of table design in mind), and thus are not adaptable for use on different surfaces.

Because of the inherent problems with the related art, there is a need for a new and improved collapsible rail system for attachment to a variety of surfaces such as a fluoroscopy or radiographic table and easily extended into a raised position or retracted into a lowered position which is flush with the surface.

BRIEF SUMMARY OF THE INVENTION

The invention generally relates to a collapsible rail system which includes a rail assembly, a lock plate and a bracket. The rail assembly will generally be comprised of an upper rail, a lower rail and a plurality of post members, wherein each of the post members is pivotally connected to both the upper rail and the lower rail so as to allow the upper rail to collapse onto the lower rail. The lock plate is positioned within a lower channel of the lower rail for locking the rail assembly in an upright position. One or more brackets are provided for removably attaching the rail assembly to a table such as a fluoroscopy or radiographic table.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
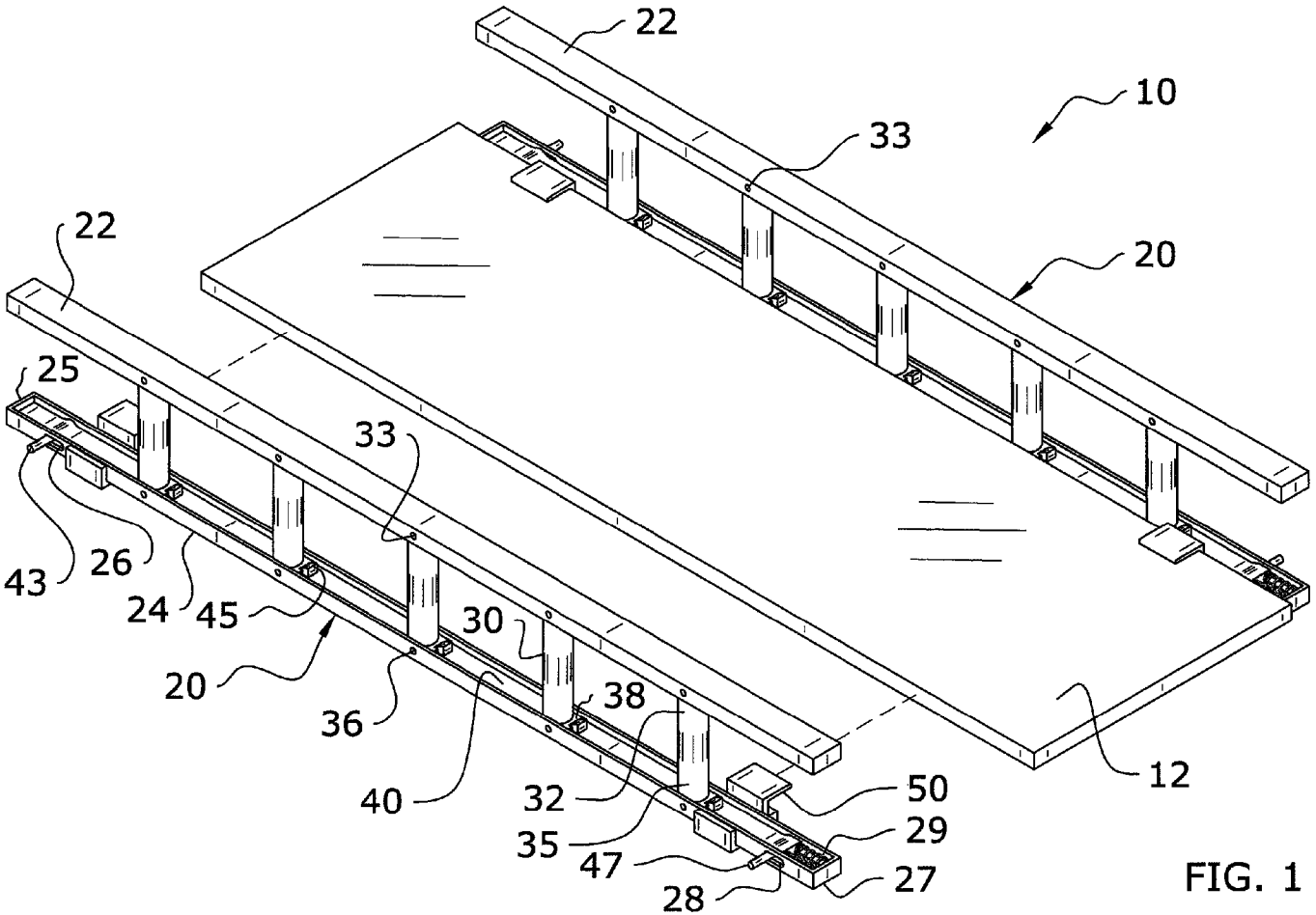
FIG. 1 is an upper perspective view of the present invention illustrating the connection of a rail assembly to a table utilizing a bracket.

A. Overview.

Turning now descriptively to the drawings, in which similar reference characters denote similar elements throughout the several views, FIGS. 1 through 8 illustrate a collapsible rail system 10, which comprises a rail assembly 20, a lock plate 40 and a bracket 50. The rail assembly 20 will generally be comprised of an upper rail 22, a lower rail 24 and a plurality of post members 30, wherein each of the post members 30 is pivotally connected to both the upper rail 22 and the lower rail 24 so as to allow the upper rail 22 to collapse onto the lower rail 24. The lock plate 40 is positioned within a lower channel 29 of the lower rail 24 for locking the rail assembly 20 in an upright position. One or more brackets 50 are provided for removably attaching the rail assembly 20 to a table 12 such as a fluoroscopy or radiographic table.

B. Table.

The present invention is adapted to be installed on one or both sides of a table 12. The present invention provides an easily collapsible railing for preventing a person from inadvertently falling off a table 12. While the present invention is primarily designed for use with fluoroscopy or radiographic tables 12, it is appreciated that various other types of tables 12 or beds may be utilized with the present invention without affecting its overall operation. Further, the design of the present invention allows its use on fluoroscopy or radiographic tables utilizing a "bucky table" design without interfering with structures specific to those type of table designs.

It should be appreciated by one of ordinary skill in the art that the present invention may be utilized on various flat structures on which objects or people are generally placed, including beds, tables, pallets and the like. As such, the structure of the table 12 utilized with the present invention should not be construed as being limited to the structure shown in the figures.

C. Rail Assembly.

The present invention will generally include a rail assembly 20 for preventing any object or person resting on the table 12 from falling off or reaching over the edges. The rail assembly 20 of the present invention is generally collapsible so as to allow a first upright position for containing the person or object on the table 12 and a second collapsed position for easing entry to and exit from the table 12 surface by the object or person.

It is preferable that, when in a collapsed position, the rail assembly 20 be flush or substantially flush with the upper surface of the table 12. It is also appreciated that, while the figures show a pair of rail assemblies 20 positioned on either side of a table 12, other embodiments of the present invention may utilize a single rail assembly 20 covering only one side of a table 12 for various applications.

As shown in FIG. 1, the rail assembly 20 of the present invention will generally include an upper rail 22 and a lower rail 24. A plurality of post members 30 are pivotally connected to both the upper rail 22 and lower rail 24 to form the rail assembly 20 of the present invention and to provide a structure for preventing any object or person positioned on the table from inadvertently falling off while the rail assembly 20 is in an upright position.

The upper rail 22 of the present invention is generally comprised of a horizontally-oriented elongated member. The upper rail 22 may be comprised of various materials, but will preferably be comprised of a metal or metal alloy which is capable of withstanding the full weight of an individual without buckling or breaking. While the upper rail 22 is shown in the figures with a rectangular cross-section, it is appreciated that various other cross-sections may be utilized, including round cross-sections.

The upper rail 22 may be comprised of various lengths, but will preferably be of a length sufficient to cover the entire length of the table 12 or bed on which the present invention is being installed. The upper rail 22 will also preferably include a channel into which the upper end 32 of a post member 30 may be inserted and pivotally secured.

The lower rail 24 of the present invention is generally comprised of a horizontally-oriented elongated member similar in structure to that of the upper rail 22. The lower rail 24 may be comprised of various materials, but will preferably be comprised of a metal or metal alloy which is capable of withstanding the full weight of an individual without buckling or breaking. While the lower rail 24 is shown in the figures with a rectangular cross-section, it is appreciated that various other cross-sections may be utilized, including round cross-sections.

The lower rail 24 may be comprised of various lengths, but will preferably be of a length sufficient to cover the entire length of the table 12 or bed on which the present invention is being installed. Further, it is preferable that the lower rail 24 be of substantially the same length as the upper rail 22.

The lower rail 24 will generally include a lower channel 29 extending for its entire length. The lower end 35 of each post member 30 will generally be pivotally secured within the lower channel 29 of the lower rail 24. The lock plate 40 of the present invention will also generally be slidably positioned within the lower channel 29 of the lower rail 24.

Figure 2:
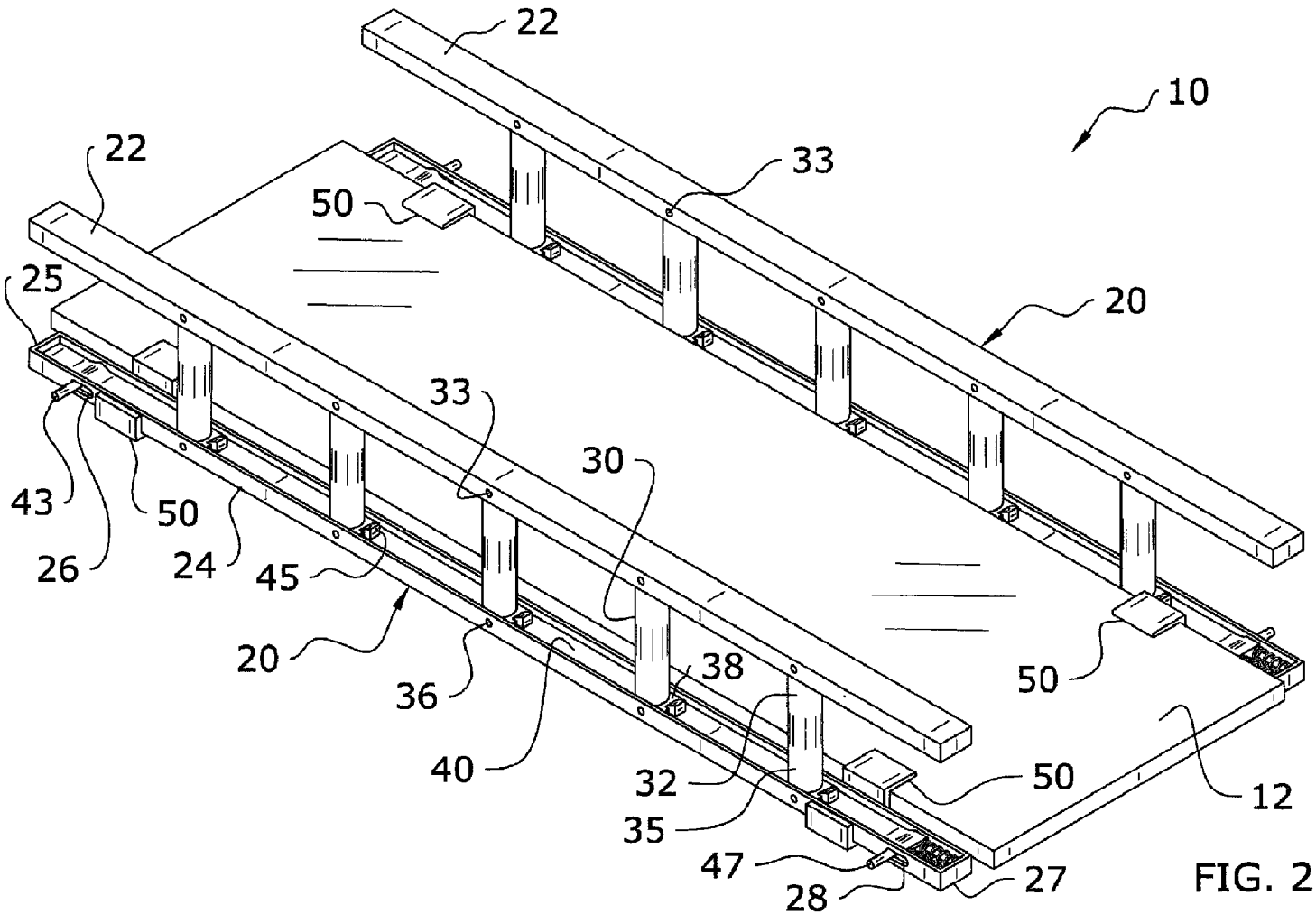
FIG. 2 is an upper perspective view of the present invention.

The lower rail 24 will also generally include a first end 25 and a second end 27. The first end 25 of the lower rail 24 will preferably include a first opening 26 through which the first handle 43 of the lock plate 40 will extend as shown in FIG. 2. The second end 27 of the lower rail 24 will preferably include a second opening 28 through which the second handle 47 of the lock plate 40 will extend. The openings 26, 28 of the lower rail 24 may be comprised of various configurations and should not be construed as being limited to the designs shown in the figures.

Figure 3:
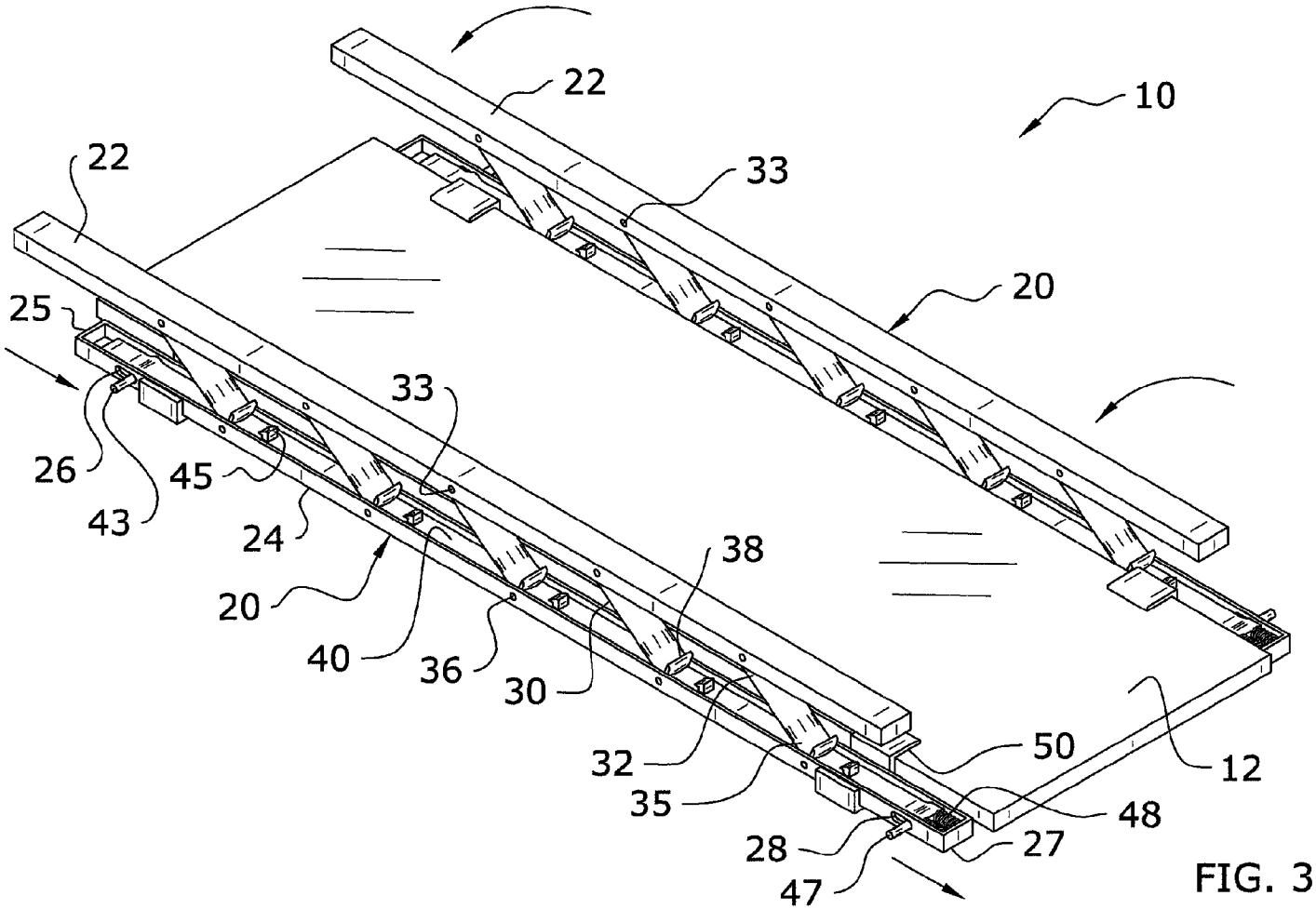
FIG. 3 is an upper perspective view of the present invention illustrating the movement of the rail assembly into a collapsed position.

The present invention will generally include a plurality of post members 30 pivotally connected to both the upper rail 22 and lower rail 24 of the collapsible rail assembly 20 as shown in FIG. 3. Any number of post members 30 may be utilized with the present invention depending on various applications, and the present invention should not be construed as being limited to the number of post members 30 shown in the figures.

Figure 4:
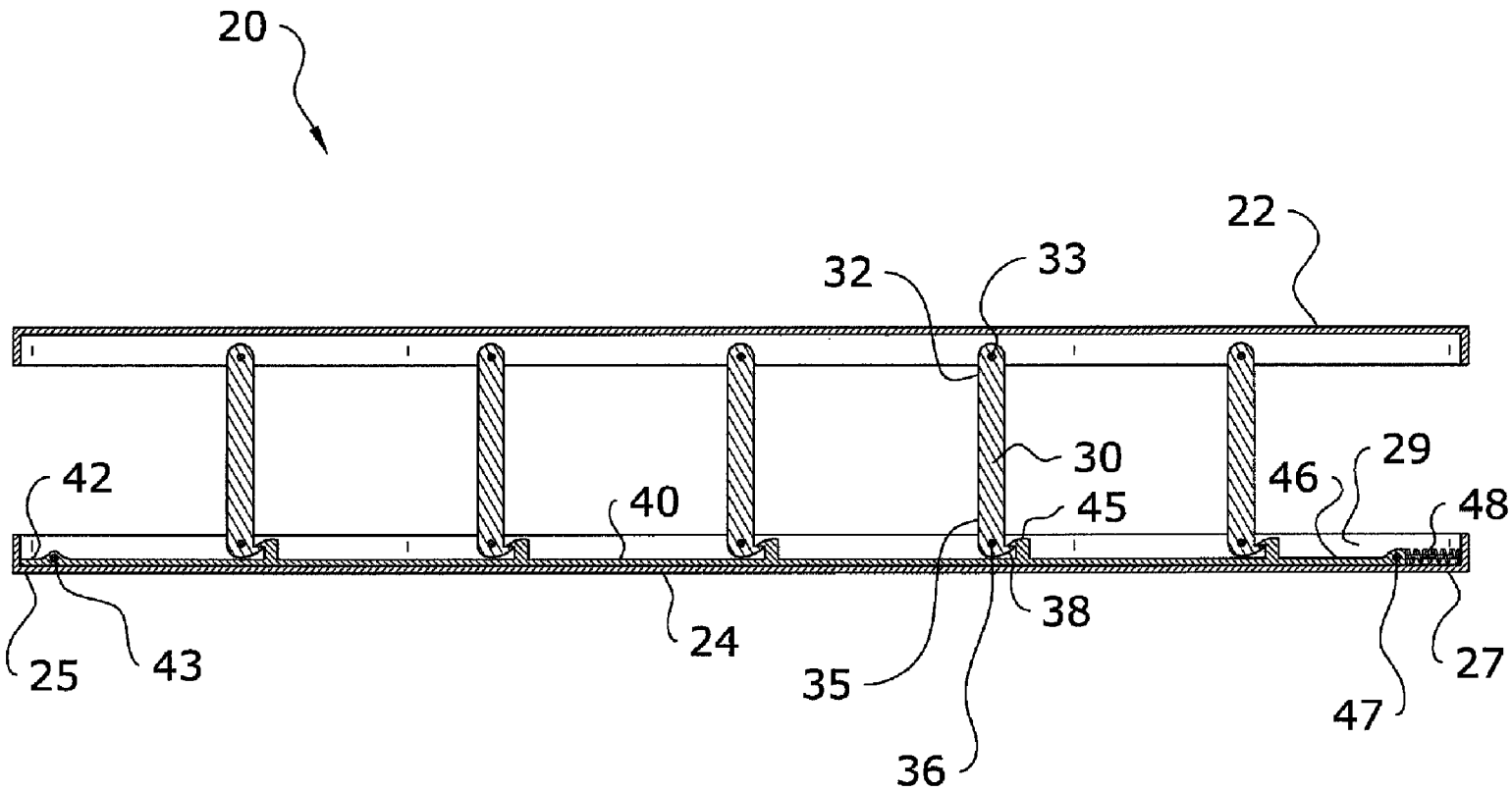
FIG. 4 is a side cutaway view of the rail assembly and lock plate of the present invention in an upright position.

As shown in FIG. 4, each post member 30 of the present invention will generally be comprised of an elongated member having an upper end 32 and a lower end 35 which extends from the upper rail 22 of the rail assembly 20 to the lower rail 24 of the rail assembly 20. The post members 30 may be comprised of various materials and designs, but will preferably be comprised of a metal or metal alloy material having a circular cross-section and a substantially cylindrical design.

Figure 5:
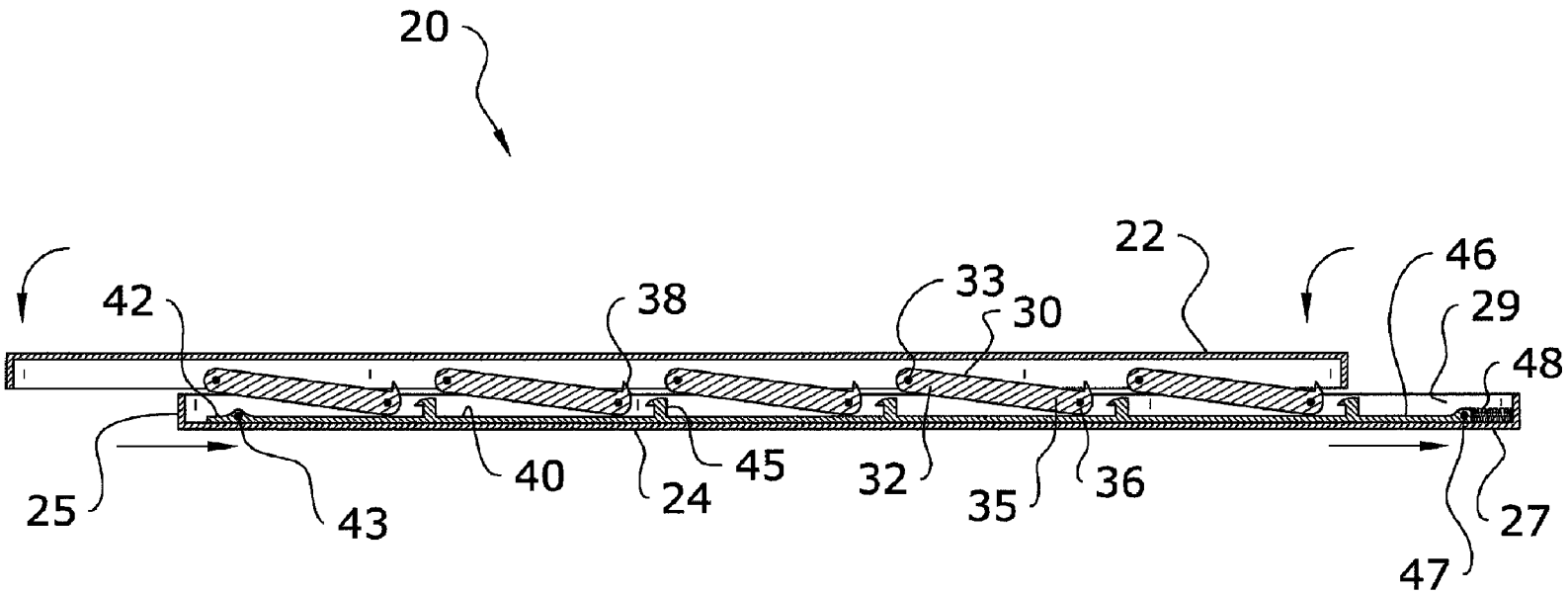
FIG. 5 is a side cutaway view of the rail assembly and lock plate of the present invention in a collapsed position.

As shown in FIG. 5, the upper end 32 of each post member 30 is pivotally connected to the upper rail 22 by a first pivot member 33 and the lower end 35 of each post member 30 is pivotally connected to the lower rail 24 by a second pivot member 36. The pivot members 33, 36 will each generally be comprised of a pin, screw or other structure which allows the upper end 32 and lower end 35 of each post member 30 to pivot with respect to the upper rail 22 and lower rail 24, respectively.

The lower end 35 of each post member 30 will also generally include a catch member 38. The catch member 38 is preferably comprised of an extension such as a hook structure which acts to engage with a corresponding catch member 45 on the lock plate 40 when the rail assembly 20 is being locked in an upright position.

D. Lock Plate.

The lock plate 40 of the present invention effectuates the locking of the rail assembly 20 in an upright position as well as the release of the rail assembly 20 into a collapsed position. The lock plate 40 will generally be comprised of an elongated, substantially flat plate which is slidably positioned within the lower channel 29 of the lower rail 24 of the rail assembly 40. While the lock plate 40 may be comprised of various designs, it will preferably have a smooth, flat upper surface so as to allow the lock plate 40 to freely slide with respect to the lower end 35 of each post member 30. Further, the lock plate 40 may be comprised of various lengths, but it is preferable that the lock plate 40 be of slightly shorter length than the lower rail 24 of the rail assembly 20 to allow room for the lock plate 40 to slide within the lower channel 29.

The lock plate 40 will generally include a first end 42 and a second end 46. The first end 42 of the lock plate 40 will generally include a first handle 43 which extends through the first opening 26 of the lower rail 24 of the rail assembly 20. The second end 46 of the lock plate 40 will generally include a second handle 47 which extends through the second opening 28 of the lower rail 24 of the rail assembly 20. The handles 43, 47 may be comprised of various configurations, but will preferably be comprised of an extension which is fixedly attached to the lock plate 40. Upon application of force to either handle 43, 37, the lock plate 40 will slide within the lower channel 29.

The upper surface of the lock plate 40 will generally include a plurality of catch members 45 for engaging with a corresponding catch member 38 on a corresponding post member 30. The catch members 45 may be comprised of various structures, but will preferably be comprised of a bracket, hook or other member which selectively engages with the catch member 38 on a post member 30 to lock the rail assembly 20 in an upright position. There will preferably be one catch member 45 on the lock plate 20 for each post member 40.

A bias member 48 will also preferably be positioned adjacent the second end 46 of the lock plate 40 to retain the lock plate 40 in a rested position absent the application of force. The bias member 48 may be comprised of various configurations, but will preferably be comprised of a spring.

E. Bracket.

The rail assembly 20 of the present invention will generally be removably mounted on the edge of a table 12 or bed through use of a bracket 50. It is appreciated that various types of brackets 50 may be utilized with the present invention so long as the rail assembly 20 is securely and removably attached to the table 12 or bed edge.

Figure 6:
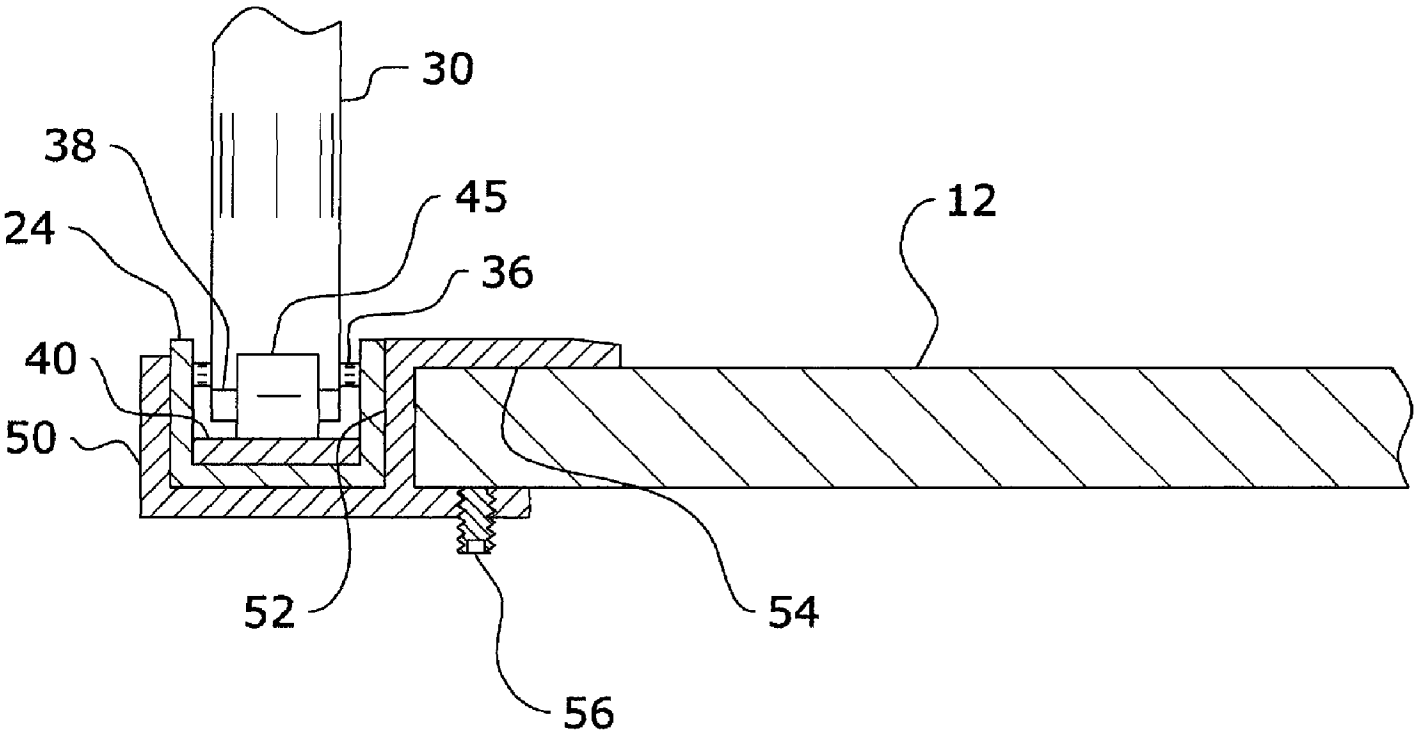
FIG. 6 is a side cutaway view of a first embodiment of a bracket utilized with the present invention.
Figure 7:
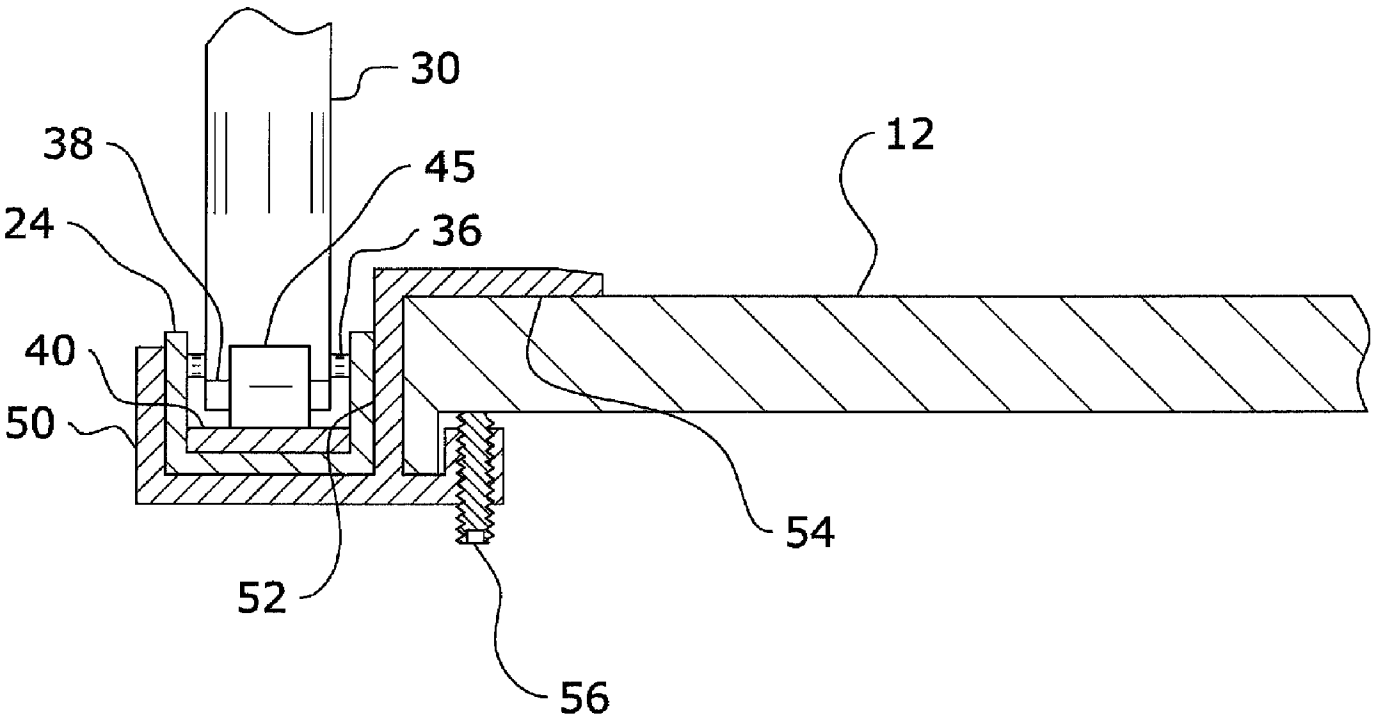
FIG. 7 is a side cutaway view of a second embodiment of a bracket utilized with the present invention.
Figure 8:
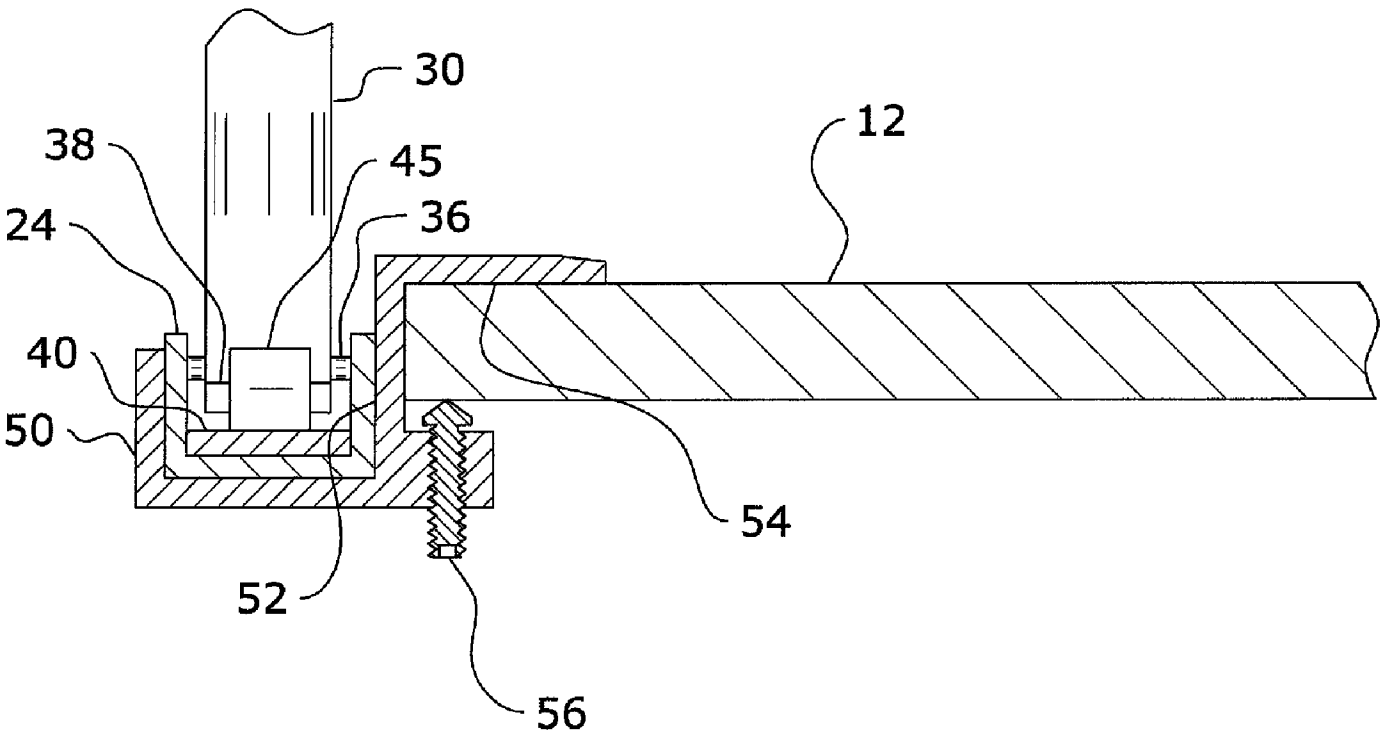
FIG. 8 is a side cutaway view of a third embodiment of a bracket utilized with the present invention.

As shown in FIG. 6, a preferred bracket 50 design will include a first slot 52, a second slot 54 and a locking member 56. The first slot 52 will generally be configured to securely and removably receive the lower rail 24 of the rail assembly 20. The second slot 54 will generally be configured to securely and removably receive the edge of the table 12 or bed onto which the present invention is being installed. The locking member 56, which will preferably be comprised of a pin or screw, will generally be utilized to provide additional support for the connection between the second slot 54 and the table 12 or bed.

F. Operation of Preferred Embodiment.

In use, one or more brackets 50 are utilized to secure the rail assembly 20 to the edge of the table 12 or bed. The second slot 54 of the bracket 50 will be positioned over the edge of the table 12 and locked in place with the locking member 56. The lower rail 24 of the rail assembly 20 is then secured in place in the first slot 52 of the bracket 50.

The rail assembly 20 may then be lowered into a collapsed position by gripping one of the handles 43, 47 of the locking plate 40, which extend through the openings 26, 28 in the lower rail 24. Upon application of force to one of the handles 43, 47, the catch members 45 of the lock plate 40 will disengage from the catch members 38 of each post member 30. After being disengaged, the post members 30 will pivot and lower the upper rail 22 of the rail assembly 20 to collapse onto the lower rail 24. Preferably, the rail assembly 20 will then be flush with the edge of the table 12 or bed, and the patient may be placed on the table 12.

When needed, the rail assembly 20 may be positioned back into an upright, locked position by gripping the upper rail 22 and lifting it upright so that the catch members 38 of each post member 30 engage with the corresponding catch members 45 of the lock plate 40.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A collapsible rail device, comprising:

an upper rail;

a lower rail, wherein said lower rail includes a lower channel;

a plurality of post members, wherein each of said plurality of post members extends between said upper rail and said lower rail;

a lock plate slidably positioned within said lower channel of said lower rail;

a handle extending from said lock plate;

at least one lock plate catch member attached to said lock plate; and at least one post catch member positioned on at least one of said plurality of post members, wherein said at least one post catch member releasably engages with said at least one lock plate catch member to lock said collapsible rail device in a raised position.

2. The collapsible rail device of claim 1, wherein an upper end of each of said plurality of post members is pivotally attached to said upper rail.

3. The collapsible rail device of claim 2, wherein a lower end of each of said plurality of post members is pivotally attached to said lower rail.

4. The collapsible rail device of claim 1, wherein said lower rail includes an opening, wherein said handle extends through said opening.

5. The collapsible rail device of claim 4, wherein said opening is positioned adjacent a first end of said lower rail.

6. The collapsible rail device of claim 5, further comprising a second handle extending from said lock plate.

7. The collapsible rail device of claim 6, wherein said lower rail includes a second opening, wherein said second handle extends through said second opening.

8. The collapsible rail device of claim 7, wherein said second opening is positioned adjacent a second end of said lower rail.

9. The collapsible rail system of claim 1, wherein said post catch member is comprised of a hook configuration.

10. The collapsible rail system of claim 9, wherein said lock plate catch member is comprised of a hook configuration.

11. The collapsible rail system of claim 1, further comprising a bias member positioned adjacent an end of said lock plate, wherein said bias member is positioned within said lower channel.

12. A collapsible rail system, comprising:

a table;

a bracket;

an upper rail;

a lower rail, wherein said lower rail includes a lower channel, wherein said lower rail is removably secured to said table by said bracket;

a plurality of post members, wherein each of said plurality of post members extends between said upper rail and said lower rail;

a lock plate slidably positioned within said lower channel of said lower rail;

a handle extending from said lock plate;

a plurality of lock plate catch members attached to said lock plate; and a plurality of post catch members positioned on at least one of said plurality of post members, wherein said post catch member releasably engages with said lock plate.

13. The collapsible rail system of claim 12, wherein said bracket includes a first slot, a second slot and a locking member.

14. The collapsible rail system of claim 13, wherein said lower rail is secured within said first slot.

15. The collapsible rail system of claim 14, wherein an edge of said table is secured within said second slot.

16. The collapsible rail system of claim 12, wherein said table is comprised of a fluoroscopy table.

17. The collapsible rail system of claim 12, further comprising a bias member positioned adjacent an end of said lock plate, wherein said bias member is positioned within said lower channel.

18. The collapsible rail system of claim 12, wherein said lower rail includes an opening, wherein said handle extends through said opening.

19. The collapsible rail system of claim 18, wherein said opening is positioned adjacent a first end of said lower rail.

20. A collapsible rail system, comprising:

a table;

a bracket, wherein said bracket includes a first slot and a second slot, wherein said table is positioned within said second slot;

an upper rail;

a lower rail, wherein said lower rail is secured within said first slot, wherein said lower rail includes a lower channel, wherein said lower rail is removably secured to said table by said bracket, wherein said lower rail includes a first end and a second end;

a plurality of post members, wherein each of said plurality of post members extends between said upper rail and said lower rail, wherein an upper end of each of said post members is pivotally attached to said upper rail and a lower end of each of said post members is pivotally attached to said lower rail;

a lock plate slidably positioned within said lower channel of said lower rail;

a bias member positioned adjacent said second end of said lock plate within said lower channel, wherein an end of said lock plate abuts against said bias member;

a handle extending from said lock plate;

a plurality of lock plate catch members attached to said lock plate; and a plurality of post catch members positioned on at least one of said plurality of post members, wherein said post catch member releasably engages with said lock plate.

* * * * *